US009049751B1

(12) United States Patent
Erle

(10) Patent No.: US 9,049,751 B1
(45) Date of Patent: Jun. 2, 2015

(54) HIGHLY CONDUCTIVE MICROWAVE SUSCEPTORS

(75) Inventor: Ulrich J. Erle, Cleveland, OH (US)

(73) Assignee: Nestec S.A., Vevey (CH)

( * ) Notice: Subject to any disclaimer, the term of this patent is extended or adjusted under 35 U.S.C. 154(b) by 979 days.

(21) Appl. No.: 13/149,534

(22) Filed: May 31, 2011

(51) Int. Cl.
*H05B 6/80* (2006.01)
*H05B 6/64* (2006.01)
*B65D 81/34* (2006.01)

(52) U.S. Cl.
CPC *H05B 6/64* (2013.01); *B65D 81/34* (2013.01); *H05B 6/80* (2013.01)

(58) Field of Classification Search
CPC ..... H05B 6/64; B65D 81/34
USPC ..... 219/678, 725, 729, 730, 759
See application file for complete search history.

(56) References Cited

U.S. PATENT DOCUMENTS

| | | | | |
|---|---|---|---|---|
| 4,283,427 | A | 8/1981 | Winters et al. | |
| 5,220,141 | A | 6/1993 | Quick et al. | |
| 5,493,103 | A * | 2/1996 | Kuhn | 219/730 |
| 5,853,632 | A * | 12/1998 | Bunke et al. | 264/42 |
| 2008/0078759 | A1* | 4/2008 | Wnek et al. | 219/730 |
| 2009/0090708 | A1* | 4/2009 | Requena et al. | 219/730 |

FOREIGN PATENT DOCUMENTS

WO WO 92/03357 3/1992

OTHER PUBLICATIONS

M. Celuch et al., "Effective modeling of microwave heating scenario including susceptors," Intn'l Conference on Recent Advances in Microwave Theory and Applications, 21-24, pp. 404-405 (Nov. 2008).
M. Celuch et al., "Properties of the FDTD method relevant to the analysis of microwave power problems," J. Microwave Power and Electromagnetic Energy, vol. 41(4), pp. 62-80 (2007).
J. Cesnek, et al., "Properties of thin metallic films for microwave susceptors," Czech. J. Food Sci., vol. 21, pp. 34-40 (2003).
W.K. Gwarek et al., "Modeling and measurements of susceptors for microwave heating applications," 10th seminar Computer Modeling & Microwave Power Engineering, Modena, Italy, 28-29 (Feb. 2008).
W.K. Gwarek et al., "Modeling and measurements of susceptors for microwave heating applications," Recent Advances in Microwave Power Applications and Techniques, IMS 2009 Workshop (Jun. 12, 2009).

(Continued)

*Primary Examiner* — Dana Ross
*Assistant Examiner* — Joseph Iskra
(74) *Attorney, Agent, or Firm* — K&L Gates LLP

(57) ABSTRACT

Microwaveable packages having highly conductive susceptors and methods for using same are provided. In a general embodiment, the microwaveable packages include a container defining an interior and having a microwave shielding material surrounding the interior. At least a portion of the microwave shielding material is a highly conductive susceptor. The highly conductive susceptor may include a standard microwave susceptor layer and a layer including a substrate having a source of mobile charges. Methods for increasing a surface heating of a food product are also provided and include, in a general embodiment, providing a food product in an interior of a container, which has a microwave shielding material surrounding the interior, and heating the food product in the container in a microwave oven for a predetermined amount of time.

16 Claims, 7 Drawing Sheets

(56) References Cited

OTHER PUBLICATIONS

J. Krupka et al., "Contact-less measurements of resistivity of semiconductor wafers employing single post and split post dielectric resonator techniques," IEEE Trans. IM, pp. 1839-1844 (Oct. 2009).

M.R. Perry et al., "Susceptors in microwave packaging," Ch. 9 in M.W. Lorence et al., Development of packaging and products for use in microwave ovens, Woodhead Publishing Limited and CRC Press, London (2009).

QuickWave-3D (1997-2009), QWED Sp.z.o.o., http://www.qwed.eu.

A. Taflove et al., "Local subcell models of fine geometric features," Ch. 10 in A. Taflove et al., "Computation Electrohydrodymanics, The Finite-Difference Time-Domain Method," 3d Edition, Artech House, Boston-London, pp. 407-462.

* cited by examiner

HIGHLY CONDUCTIVE MICROWAVE SUSCEPTORS

BACKGROUND

The present disclosure relates to food technologies. More specifically, the present disclosure relates to highly conductive microwave susceptor materials that are able to impart increased surface heating to a microwaveable product.

Microwave susceptor materials are known in the food industry and have been used as active packaging systems with microwaveable foods since the late 1970's. Susceptors are used to provide additional thermal heating on the surface of food products that are heated in a microwave oven, which helps to achieve a browned, crisp surface that is desirable to consumers.

It is, however, difficult to achieve a highly conductive microwave susceptor because of the negative effects of providing a thicker metal susceptor material. For example, when the thickness of the metal layer within a standard susceptor material is increased and the susceptor covers a large area, the electrical field strength in the microwave oven can rise to a level where the susceptor materials yield (e.g., develops cracks). The cracks change the electrical conductivity of the standard susceptor, making the materials more transmissive and, consequently, the materials lose their desired properties.

SUMMARY

The present disclosure is related to microwaveable packages and methods for using same. In a general embodiment, a microwaveable package includes a container defining an interior and having a microwave shielding material surrounding the interior, wherein at least a portion of the microwave shielding material is a highly conductive susceptor.

In an embodiment, the highly conductive susceptor has an electrical resistance that is below about 100 Ω, or from about 10 Ω to about 80 Ω.

In an embodiment, the microwave shielding material is entirely comprised of the highly conductive susceptor.

In an embodiment, a second portion of the microwave shielding material is a pure microwave shield. The pure microwave shield may be a metal layer such as, for example, a layer of aluminum foil.

In an embodiment, the highly conductive susceptor includes (i) a standard microwave susceptor layer and (ii) a shielding layer having a substrate including a source of mobile charges. The shielding layer may be at least substantially metal free. The substrate may have a thickness from about 0.05 mm to about 3.0 mm, or about 0.25 mm. In an embodiment, the substrate is a paper-based substrate such as, for example, tissue paper.

In an embodiment, the source of mobile charges is selected from the group consisting of melted ionic compounds, dissolved ionic compounds, semiconductors, or combinations thereof. The source of mobile charges may be selected from the group consisting of melted salt, salt water solution, or combinations thereof. In an embodiment, the source of mobile charges is a salt water solution having a concentration from about 10% to about 30% by weight. The salt water solution may have a concentration of about 25% by weight. In an embodiment, the microwave shielding layer is tissue paper immersed in a salt water solution.

In an embodiment, the shielding layer covers substantially all of an outside surface of the standard susceptor layer. The shielding layer may be adjacent to and contacting the standard microwave susceptor layer.

In an embodiment, the highly conductive susceptor comprises a second standard microwave susceptor layer.

In another embodiment, a method for increasing a surface heating of a food product is provided. The method includes the step of providing a food product in an interior of a container, the container including a microwave shielding material surrounding the interior, and heating the food product in the container in a microwave oven for a predetermined amount of time. In an embodiment, at least a portion of the microwave shielding material is a highly conductive susceptor.

In an embodiment, the predetermined amount of time is between about 30 seconds to about 90 seconds, or from about 45 seconds to about 60 seconds. In an embodiment, the predetermined amount of time is from about 30 seconds to about 4 minutes.

In an embodiment, the highly conductive susceptor comprises an electrical resistance that is below about 100 Ω.

In an embodiment, the microwave shielding material is entirely comprised of the highly conductive susceptor.

In an embodiment, a second portion of the microwave shielding material is a pure microwave shield. The pure microwave shield may be a metal layer such as, for example, a layer of aluminum foil.

In an embodiment, the highly conductive susceptor includes (i) a standard susceptor layer and (ii) a shielding layer including a substrate including a source of mobile charges, wherein the shielding layer is at least substantially metal free.

In an embodiment, the substrate may have a thickness from about 0.05 mm to about 3.0 mm, or about 0.25 mm. In an embodiment, the substrate is a paper-based substrate such as tissue paper.

In an embodiment, the source of mobile charges is selected from the group consisting of melted ionic compounds, dissolved ionic compounds, semiconductors, or combinations thereof. The source of mobile charges may be selected from the group consisting of melted salt, salt water solution, or combinations thereof. In an embodiment, the source of mobile charges is a salt water solution having a concentration from about 10% to about 30% by weight. The salt water solution may have a concentration of about 25% by weight. In an embodiment, the microwave shielding layer is tissue paper immersed in a salt water solution.

In an embodiment, the shielding layer covers substantially all of an outside surface of the standard susceptor layer. The shielding layer may be adjacent to and contacting the standard microwave susceptor layer. The shielding layer is typically placed on an outer portion of the standard microwave susceptor layer. The microwave shielding layer may be attached to the standard microwave susceptor layer by any known means. For example, the microwave shielding layer may be attached to the standard microwave susceptor layer by glue, tape, or combinations thereof.

In an embodiment, the highly conductive susceptor includes a second standard microwave susceptor layer located between the first standard microwave susceptor layer and the shielding layer.

An advantage of the present disclosure is to provide an improved microwave susceptor.

Another advantage of the present disclosure is to provide an improved microwave susceptor that creates a temperature profile in a food product that is similar to that achieved by conventional oven preparation.

Yet another advantage of the present disclosure is to provide a microwave susceptor that provides improved browning and crispness of a food product.

Still yet another advantage of the present disclosure is to provide a microwave susceptor that imparts a stronger surface heating to a food product.

Yet another advantage of the present disclosure is to provide a method to increase the conductivity of a standard microwave susceptor.

Another advantage of the present disclosure is to provide an improved method for microwave cooking a food product.

Additional features and advantages are described herein, and will be apparent from, the following Detailed Description and the figures.

DETAILED DESCRIPTION

Figure 1:
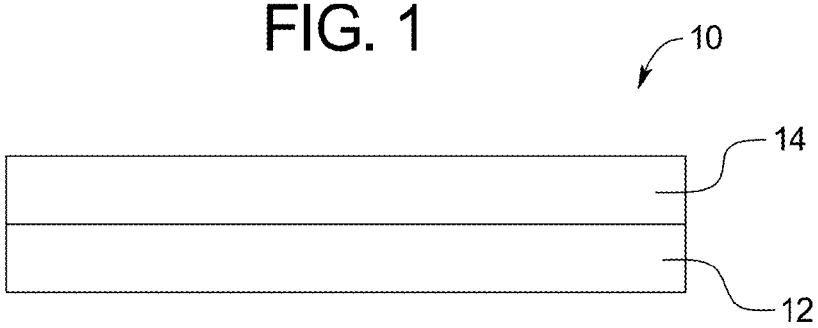
FIG. 1 is a side view of a composite susceptor in accordance with an embodiment of the present disclosure.

Microwave susceptor materials are known in the food industry and have been used as active packaging systems with microwaveable foods since the late 1970's. Susceptors are used to provide additional thermal heating on the surface of food products that are heated in a microwave oven, which helps to achieve a browned, crisp surface that is desirable to consumers.

Although there are several different types of susceptors in use, most susceptors are aluminum metallized polyethylene terephthalate ("PET") sheets. The PET sheets are lightly metallized with elemental aluminum laminated onto a dimensional stable substrate such as, for example, paper or paperboard. Indeed, standard susceptor materials have a very thin layer of metal atoms (e.g., aluminum atoms). This thin layer is typically about 20 atoms and is just thick enough to conduct electricity. Since the thickness of the layer is so small, however, and the resulting resistance is high, the currents are limited and do not cause any arcing in the microwave, as is seen with other metallic articles in the microwave. The current is sufficiently high, however, to heat the susceptor to a temperature that is high enough to provide brownness and crispness to the outside surface of a food product. As used herein, "standard microwave susceptor" or "standard susceptor" means susceptors known to the skilled artisan prior to the present disclosure, which may include, for example, the lightly metallized susceptors described above having a substrate, a thin layer of metal atoms and a polymer layer.

The development of heat energy in a susceptor placed in a microwave field is caused by the conductivity of the susceptor material. For example, a thin aluminum film with a relatively high resistance acts as the main source of heat energy. The ohmic resistance in the thin aluminum layer then leads to absorption and dissipation of microwave energy. The portion of an incident wave that is not absorbed, is partially transmitted by the susceptor material, making it available for direct volumetric heating of the food. The remaining portion of the microwave energy is reflected by the susceptor material.

This concept of standard susceptor heating works reasonably well for frozen food, which is essentially transparent to microwaves and does not absorb much microwave energy itself. As a result, a relatively high electric field strength is left for the susceptor to heat up and form a crust on the surface of the food. Non-frozen foods, however, absorb microwaves much better than frozen foods. The field strength, therefore, is much lower, which leads to less heating effect in the susceptor material. Consequently, standard susceptor materials often show insufficient performance in combination with non-frozen foods.

Better heating of a non-frozen food product can be reached, however, using a susceptor material with a thicker layer of metal, which shows a higher electrical conductivity. If the thickness of a metal layer is properly chosen, the heating effect of the material at a given field strength is at least slightly higher than a standard susceptor, but the ratio of reflection and transmission changes dramatically. As will be discussed further below, the power dissipated by the susceptor goes up as the conductivity increases. Indeed, most of the non-absorbed microwave energy is now reflected. The reflection has two effects. First, if the food is completely covered with the thicker susceptor material, direct volumetric heating of the food is kept very low. Second, due to multiple reflections of microwaves in the oven, most of the reflected energy hits the susceptor again, causing a higher field strength and, thus, a stronger surface heating. In this manner, the susceptors can provide, in principle, sufficient shielding from the microwaves while, at the same time, heating up enough to provide increased surface heating to the food product.

It is, however, difficult to achieve such a highly conductive microwave susceptor because of the negative effects of providing a thicker metal susceptor material. For example, when the thickness of a standard susceptor material is increased, the electrical field strength in the microwave oven can rise to a level where the susceptor materials yield (e.g., develops cracks). The cracks change the electrical conductivity of the standard susceptor, making the materials more transmissive and, consequently, the materials lose their desired properties.

At best, current microwave susceptors can either shield a food product from microwaves, or heat the food surface, but still transmit a substantial portion of the microwaves. Additionally, known susceptors cannot be used to encase the food product from all sides because, as described above with thickened susceptor materials, the electrical field strength in the oven rises to a level where the material yields (e.g., develops cracks). Any cracks formed in the susceptor material can change the electrical conductivity and make the susceptor more transmissive, which imparts too much microwave energy to the food product.

The microwaveable packages and methods of the present disclosure are directed to overcoming the above-described poor heating performance of standard microwave susceptor materials. Better heating performance may be obtained by providing a highly conductive susceptor that is able to function as both a shield and a source of heat to heat a food product.

Applicants have simulated the heating behavior of a model food having the dielectric properties of water in a household microwave oven. The food was simulated as a cylindrical food completely enrobed in a susceptor material from all sides. The goal of the simulation was to identify the optimal value for the electrical conductivity of the susceptor for a maximum ratio between surface and volumetric heating. Applicants surprisingly found that optimal results were achieved with resistivities that were well below 100 Ω. As such, Applicants' simulation has shown that standard susceptor materials do not provide maximum surface heating when they cover the food from all sides. Consequently, materials with high metallization (i.e., lower resistance) were tested. However, the desired surface heating was not achieved because the higher metallized materials developed cracks in their aluminum layers, rendering them much more transmissive than in their intact condition. Because of the above-described deficiencies, Applicants sought to develop a highly conductive susceptor that is able to provide a desired temperature profile in a microwave oven without failure.

Applicants have surprisingly found that providing a highly conductive susceptor and completely encasing a food product with the highly conductive susceptor, a microwaveable package can impart a temperature profile that shifts the heating pattern from typical microwave volumetric heating toward increased surface heating. In an embodiment, a highly conductive susceptor is a composite susceptor that includes at least one standard susceptor layer and a shielding layer having a source of mobile charges, wherein the source of mobile charges is at least substantially metal free.

In a general embodiment, and as shown in FIG. 1, a composite susceptor 10 of the present disclosure may include one to three layers of a standard microwave susceptor 12, to which another layer 14, designed to protect or shield, the standard susceptor from too high electrical fields, is added. The protective or shielding layer of the present disclosure is at least substantially free of metal such that the protective or shielding layer 14 cannot be a standard microwave susceptor layer.

Standard microwave susceptor layer(s) 12 of the present composite susceptors may be any susceptor material known to the skilled artisan. As discussed above, standard susceptor materials typically include a substrate upon which a coating for absorption of microwave radiation is deposited, printed, extruded, sputtered, evaporated, or laminated. As mentioned previously, most standard susceptors include a paper substrate with a thin layer of aluminum deposited thereon and covered by a plastic film. The composite microwave susceptor packages of the present disclosure may include one or more layers of a standard susceptor material. In an embodiment, the composite susceptors of the present disclosure include one layer of a standard susceptor material. In another embodiment, the composite susceptors include two or more layers of a standard susceptor material.

The protective (or shielding) layer 14 of the present composite susceptors is capable of acting as a shield to shield standard susceptor 12 from microwaves, while also acting as a conductor to increase the conductivity of the composite susceptor. Such a shielding layer may include materials that are capable of being stored and handled at temperatures that are typical for frozen or chilled foods. The shielding layer may also include materials that can be cooked in a microwave oven or stored on a shelf.

In an embodiment, shielding layer 14 of the highly conductive susceptors of the present disclosure may have an electrical resistance between, for example, about 1 Ω and about 300 Ω. In an embodiment, shielding layer 14 of the highly conductive susceptors has an electrical resistance that is less than about 100 Ω. In another embodiment, shielding layer 14 of the highly conductive susceptors may have an electrical resistance that is from about 10 to about 80 Ω, or from about 20 to about 60 Ω, or from about 30 to about 50 Ω. In contrast, standard susceptors may have an electrical resistance from about 100 Ω to about 200 Ω.

The shielding layer may be continuous or discontinuous on the standard susceptor layer. For example, if the shielding layer is discontinuous, the shielding layer may be applied in strips to the standard susceptor layer, or in squares, or circles, or any other shape or pattern, so long as the shielding layer is able to shield at least a portion of the standard microwave susceptor from microwaves, as well as provide added conductivity thereto. In this manner, the shielding layer may cover from about 25% up to 100% of an outer surface of the standard susceptor layer. In another embodiment, the shielding layer may cover from about 40% up to about 80%, or about 50% to about 75% of an outer surface of the standard susceptor layer. On the other hand, the shielding layer may be continuous over the standard susceptor layer such that the shielding layer covers substantially all of an outer surface of the standard susceptor layer.

In an embodiment, the shielding layer may be a strong dielectric (a material having a high value for $\in'$) or a dielectric with a high loss factor ($\in''$). Both materials, or combinations thereof are suitable to reduce the electrical field strength at the susceptor, which prevents cracking of the susceptor. In an embodiment, the protective, or shielding layer may comprise a source of mobile charges that is at least substantially metal free. Examples of sources of mobile charges include, but are not limited to, ionic compounds (melted or dissolved), semiconductors, etc. An example of a component having very high numbers for $\in''$ includes concentrated salt solutions, melted salt, etc. However, the values of $\in''$ for concentrated salt solutions will depend on temperature. Concentrated salt solutions also offer the advantage that water can evaporate from them, which holds the susceptor at a temperature level where it heats the food but does not suffer heat damage. This concept can be referred to as "sacrificial load." It is useful in cases where the microwave power is higher than what can be dissipated in the packaging and/or food without causing damage to the susceptor. As used herein, "salt" includes any ionic compound including, for example, potassium chloride, sodium chloride, etc. In an embodiment, the salt is sodium chloride.

Shielding layer 14 may include a substrate to which a source of mobile charges is added. The substrate may be a liquid absorbent, flexible material. For example, the substrate may be paper, paperboard, cardboard, cardstock, tissue paper, crepe paper, etc. In an embodiment, shielding layer 14 includes a paper-based substrate that has a weight up to about 100 g/m$^2$. The substrate may be selected based upon the absorbency of the substrate. In an embodiment, the substrate is a tissue paper that has a weight from about 10 to about 70 $g/m^2$, or about 15 to about 60 $g/m^2$, or about 20 to about 35 $g/m^2$.

The substrate of shielding layer 14 may have a thickness from about 0.05 mm to about 3.0 mm. In an embodiment, the substrate has a thickness from about 0.1 mm to about 2.0 mm, or from abut 0.2 mm to about 1.5 mm, or from about 0.3 mm to about 1.0 mm, or about 0.5 mm to about 0.8 mm. In an embodiment, the substrate has a thickness of about 0.25 mm. The substrate of shielding layer 14 should not be too thick to prevent standard susceptor 12 from achieving a sufficiently high baking temperature. On the other hand, the substrate of shielding layer 14 should not be too thin so as to provide poor shielding such that standard susceptor 12 rises in temperature too quickly and cracks before an optimal food surface temperature is achieved.

The composition having mobile charges may be added to the substrate by any known means. For example, the composition having mobile charges may be added to the substrate by immersion, deposition, printing, extrusion, sputtering, evaporation, plating, or lamination. In an embodiment, the substrate may be dipped in an ionic solution. In an alternative embodiment, however, a substrate need not be used and shielding layer 14 may simply be a composition having mobile charges.

As briefly mentioned above, the source of mobile charges may include, for example, a salt solution, melted salt, or combinations thereof. The source of mobile charges may also include, for example, melted ionic compounds, dissolved ionic compounds, semiconductors, or combinations thereof. In an embodiment, the source of mobile charges is a sodium chloride solution in which tissue paper (as a substrate) may be dipped. The salt water (e.g., sodium chloride) solution may have a concentration from about 10% to about 30%. In an embodiment, the salt water solution has a concentration from about 12% to about 28%, or about 15% to about 25%, or about 17% to about 23%. In an embodiment, the salt water solution has a concentration of about 25%.

In another embodiment, the salt water solution may be provided in any amount up to its saturation point, which will depend on temperature. In this manner, the skilled artisan will appreciate that other salts with different solubility limits and different numbers of ions with different charges may be used. It is understood, therefore, that different salts (e.g., sodium, potassium, lithium, etc.) may provide different specific conductivities, which may require varying thicknesses of the substrates of shielding layer 14, and varying concentrations of the salt water solution. In an embodiment, the source of mobile charges is a salt water solution that has a concentration up to about 50%. For the remainder of the disclosure, shielding layer 14 of the present composite microwave susceptors will be discussed as a tissue paper substrate that is dipped in a salt water solution and placed on top of, or an outer portion of, standard susceptor 12. However, the skilled artisan will appreciate that other sources of mobile charges may be used with the composite susceptors of the present disclosure.

Shielding layer 14 of the present composite susceptors can serve at least two functions. First, if the food is completely covered with the present composite susceptor material, direct volumetric heating of the food product is kept very low, and the shielding layer 14 shields standard susceptor layer 12 to prevent standard susceptor layer 12 from becoming too hot and cracking. In this manner, shielding layer 14 on the outside of standard susceptor 12 provides a shielding effect for standard susceptor layer 12. Additionally, standard susceptor 12 in combination with shielding layer 14 can prevent transmission of microwaves into the food.

Shielding layer 14 also aids in increasing the heat dissipated by standard susceptor 12. For example, as will be discussed below, in a first portion of microwave cooking, the heating by standard susceptor 12 is reduced by the shielding effects of shielding layer 14. As the cooking process continues, and the water absorbed by the substrate of shielding layer 14 is evaporated, standard susceptor 12 gets the full electrical field and provides increased surface heating to a food product. Thus, both the lifetime and the heat dissipated by standard susceptor 12 are increased, with higher temperatures occurring at the end of the cooking cycle. In other words, because of the initial shielding effect of shielding layer 14, standard susceptor 12 may be used for a longer period of time without cracking or otherwise yielding.

In an embodiment wherein shielding layer 14 includes a substrate immersed in an aqueous solution (e.g., tissue paper dipped in a salt water solution), shielding layer 14 also provides the added benefit that the water absorbed by the substrate will evaporate during baking in a microwave oven to provide a better temperature in the last portion of cooking (e.g., the last 15 to 45 seconds of cooking). In this manner, evaporation of the water in the substrate decreases the shielding effect of shielding layer 14 that is present in a first portion of baking, which allows standard susceptor 12 to increase in temperature during a second, or a last portion, of baking to provide improved heating and/or a browned, crisp surface to the food product.

For example, shielding layer 14 may provide sufficient shielding for up to 30 seconds, or up to 40 seconds or up to 45 seconds before the water in shielding layer 14 begins to evaporate and, therefore, cause shielding layer 14 to lose shielding power. In a second portion of heating (e.g., after about 20 seconds, or about 30 seconds, or about 40 seconds of a first heating time), standard susceptor 12 will ramp up in temperature quickly, which imparts a more intense surface heat to the food product being baked. This second portion of heating may also last up to 30 seconds, or up to 40 seconds or up to 45 seconds. In another embodiment, a first portion of heating may be an amount of time that is up to about 2 minutes and a second portion of heating may be an amount of time that is up to about 2 minutes. Further, the water contained in shielding layer 14 also helps to protect standard susceptor 12 by acting as a heat sink, reducing the temperature of standard susceptor 12.

Additionally, as mentioned above, adding shielding layer 14 to standard susceptor 12 creates a highly conductive susceptor having an electrical conductivity that is greater than just standard susceptor 12 alone. For example, in an embodiment where the highly conductive susceptors are used with microwaveable packages including containers defining an interior, and the highly conductive susceptor surrounds the interior, most of the non-absorbed microwave energy is reflected back upon itself. However, due to multiple reflections in an oven, most of the reflected microwave energy will be directed to hit the composite susceptor again, which causes a higher field strength and, thus, a stronger surface heating.

Indeed, Applicants have surprisingly found that when a food product is completely enrobed in microwave shielding materials such as, for example, the highly conductive susceptors of the present disclosure, there may be essentially zero transmission of microwaves into the food. Instead, the heating configuration shifts the heating pattern in the microwave toward surface heating instead of volumetric heating. As such, the susceptors and methods of the present disclosure are able to provide food products with improved crust formation and enhanced crispness, especially when the food is entirely enrobed by the microwave shielding materials.

In an embodiment wherein the composite susceptors of the present disclosure are used in microwaveable packaging, shielding layer 14 of the present disclosure should be provided on an outside of the standard susceptor 12 so as not to contact any food contained within the packages. This may be especially important where the shielding layer is tissue paper dipped in a salt water solution because the food contained in the packaging would have undesirable properties if exposed to sodium chloride, or another salt, or excessive moisture during storage.

On the other hand, however, the skilled artisan will appreciate that the inner, standard susceptor layer 12 may have some thermal contact with a food product housed by the microwaveable package. Thermal contact between the standard susceptor layer 12 and the food product will allow heat transfer from the standard susceptor layer 12 to the food product, which not only heats the food product, but also helps to reduce the temperature of the standard susceptor layer 12 to avoid cracking. In an embodiment, the composite susceptor 10 (via the standard susceptor layer 12) contacts at least about 50% to about 100% of a total surface area of the microwaveable food. Composite susceptor 10 may also contact from about 60% to about 90% of a total surface area of the microwaveable food. Alternatively, composite susceptor 10 does not contact the microwaveable food.

Further, although steam will likely be generated in a microwave packaging during microwave cooking of a food product, the steam is not intended to be used to cook the food product.

The skilled artisan will appreciate that composite susceptor 10 may be used with any microwaveable application where a highly conductive microwaveable susceptor would be advantageous. For example, composite susceptor 10 may be included in microwave active packaging such as a pouch, a box, a sleeve, a cylinder, etc., or any flexible material that may be used for packaging In an embodiment wherein composite susceptor 10 is used in a microwaveable package as a highly conductive susceptor to heat a microwaveable food, composite susceptor 10 may be included along all sides or walls of the package such that every surface of the microwaveable package includes a composite susceptor. In other words, if a microwave package defines an interior, the interior may be completely surrounded by composite susceptor 10. The skilled artisan will appreciate, however, that the microwaveable package may be vented or otherwise minimally exposed to an environment outside the package so long as the interior of the package is substantially surrounded by composite susceptor 10.

Alternatively, however, the skilled artisan will appreciate that other embodiments of microwaveable packages may include composite susceptor 10 over only a portion of the surfaces of the microwaveable package. Accordingly, composite susceptor 10 may be provided on about 50% to 100% of a total surface area of a microwaveable package. In another embodiment, composite susceptors 10 may be included on about 60% to about 80% of a total surface area of a microwave package. In such an embodiment, however, the remaining surface area of the microwaveable package should include another microwave shielding material such as, for example, a pure microwave shield. As used herein, a "pure microwave shield" or "complete microwave shield" means any microwave shielding material that prevents transmission of microwaves therethrough and substantially does not heat up during microwave cooking. In this manner, a pure microwave shield is distinguishable from shielding layers (e.g., shielding layer 14) of the present composite susceptors, which heat up during microwave cooking. An example of a pure, or complete, microwave shield is an aluminium foil layer.

The susceptors and methods of the present disclosure are able to provide several consumer benefits including, but not limited to, greater surface heating of food products, insulation of a food product from the effects of heat sinks in a microwave oven environment, and retention of proper amounts of heat and moisture. Additionally, the salt contained in the shield layer helps to keep some or all of the water unfrozen at −18° C., which means that the shield is already active when the food is removed from the freezer. Further, after evaporation of a portion of the water during microwave cooking, a consumer is able to touch the dry substrate of the shield layer without burning his or her hand.

By way of example and not limitation, the following Examples are illustrative of embodiments of the present disclosure. In the Examples, all percentages are by weight unless otherwise indicated.

EXAMPLES

Example 1

Microwave Susceptor Simulations

Applicants used numerical modeling to analyze conductivity and shielding effects of microwave susceptors used as an active element in packaging of microwaveable food products. The accuracy of the method was validated in the case of estimation of reflected, absorbed, and transmitted power for the susceptor in free space, where the exact solution is known. The amount of power absorbed by the susceptor was calculated for the case of the susceptor attached to a cylinder made of water, the influence of the position and size of the cylinder was considered, and the amount of power absorbed by the susceptor and the cylinder were calculated.

As described above, a microwave susceptor is typically formed from a metal layer of thickness of a few nanometers deposited on a thin film of a polymer such as, for example, PET, which is reinforced by a paper substrate.[1,2] The susceptor works to convert electromagnetic energy into heat and, when it is in contact with microwavable food products, it acts a conventional source of heat and enables browning and crisping of outer product surfaces. The ability of such a thin metal layer to work as a susceptor is described by the amount of reflected, absorbed, and transmitted power ("RAT properties"), or its surface resistance. The surface resistance of a thin metal layer is typically defined as:

$$R_S=1(\sigma^*d) \quad \text{(Equation 1)},$$

where "σ" is the electric conductivity of the metal used for the susceptor (S/m), and "d" is the thickness of the metal layer (m). The surface resistance of manufactured susceptors can be measured using a resonant method.[3]

Equation 1 may be used for effective finite-difference time-domain ("FDTD") modeling of the susceptor.[4,5,6] As will be appreciated by the skilled artisan, a brute-force FDTD approach would require mesh refinement to the thickness of the susceptor and prohibitive computer effort. Sub-cellular FDTD models of thin perfect electric conductor ("PEC") sheets, however, are not applicable to the susceptors since they do not capture the semi-transparent properties.[7] Therefore, the numeric modeling in this Example was based on a thicker surrogate dielectric layer instead of a thin metal film. The proper electric conductivity of the surrogate layer was calculated using Equation 1, which was reformulated as:

$$\sigma=1/(R_s^*d) \quad \text{(Equation 2)},$$

where "$R_s$" is the surface resistance of the thin metal layer and "d" is the thickness of the assumed surrogate dielectric layer.

All of the present simulations were conducted using QuickWave-3D software for electromagnetic design.[8]

Accuracy of the Surrogate Layer Approach

The accuracy of the surrogate model was investigated with respect to RAT properties of the flat susceptor in free space, in which case the exact solution was known.[1,4,5,6] The influence of the thickness of the assumed surrogate dielectric layer was investigated for several values of the surface resistance.

Description of Test Case

A parallel plate line with perfect electric conductor boundary condition along the x-axis and perfect magnetic conductor boundary condition along the y-axis were chosen to simulate free space conditions. The computational domain included a 10 mm space for the perfect magnetic conductor boundary conditions, and a 10 mm space for the perfect electric conductor boundary conditions. The computation domain also include a space of 5 mm from the excitation port to the x-axis and a space of 5 mm from the excitation port to the y-axis. From both the x and y-axis, a space of 5 mm to the superabsorbing boundary condition was used. The surrogate dielectric layer was located in the x, y plane.

Instead of a thin metal layer, the surrogate thicker dielectric layer of proportionally lower electric conductivity calculated using Equation 2 was used and the value of relative dielectric constant of the surrogate dielectric layer was set to 1. A TEM pulse of frequency spectrum between 2 and 3 GHz was used to excite the structure. The amounts of reflected power ($P_R$) and transmitted power ($P_T$) were calculated as squares of the collected reflection and transmission coefficients at 2.45 GHz. The missing value of the absorbed power $P_A$ was obtained from the energy conservation equation:

$$P_R+P_A+P_T=1 \quad \text{(Equation 3)}$$

Computational domain was ended by the superabsorbing boundary condition and a set of simulations was performed for different thicknesses of the surrogate dielectric layer and different surface resistance. The FDTD cell size was set to be equal to the thickness of the surrogate dielectric layer.

Results from Test Case

Figure 2:
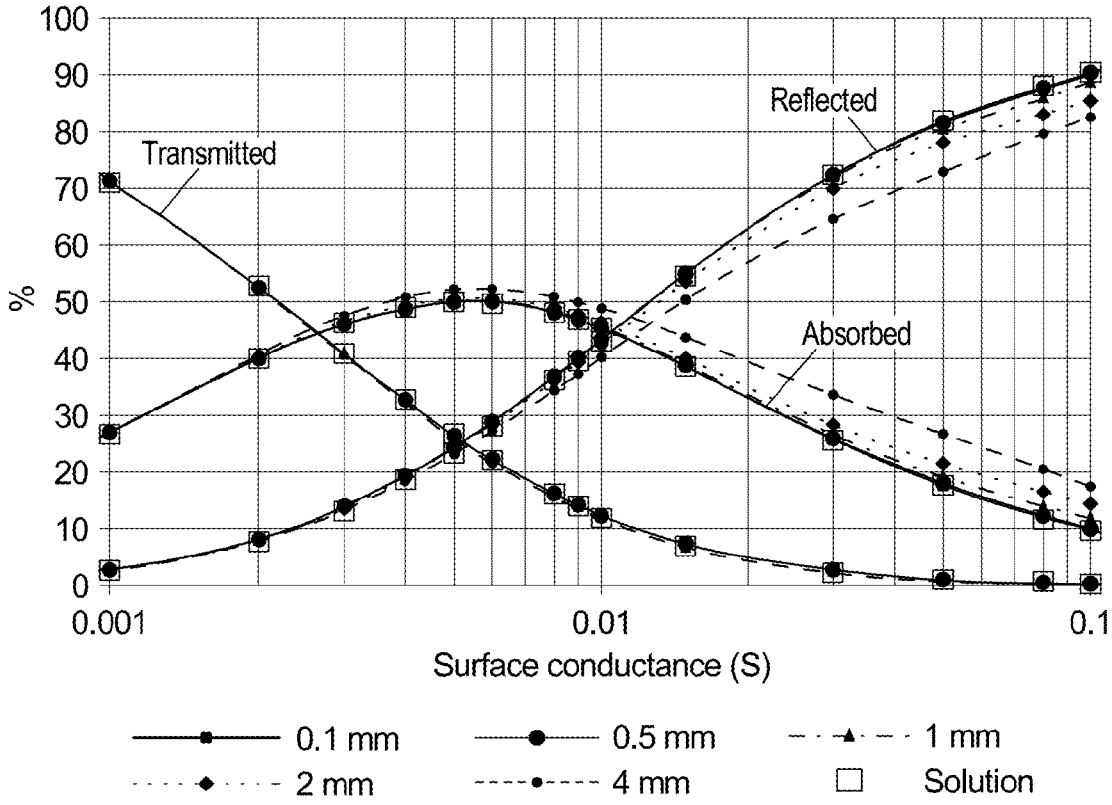
FIG. 2 is a graph of RAT properties of a susceptor in free space as a function of the surface conductance, with thickness of the surrogate dielectric layer as a parameter.

FIG. 2 shows RAT properties taken at 2.45 GHz for the susceptor in free space, for different values of thickness of the surrogate dielectric layer in the range 0.1, 4.0 mm, and for different values of the surface conductance, which is a reciprocal of the surface resistance in the range 0.001, 0.01 S. The susceptor of surface conductance around 0.005 S provides a maximum level of absorption equal to 50%, with reflection and transmission at the same level of 25%.

The results of the numerical simulation were compared to the analytical solution[1] for a plain metal susceptor with cracks:

$$P_R=1/(2*R_S/Z_O+1)^2 \quad \text{(Equation 4),}$$

$$P_A=4*(R_S/Z_O)/(2*R_S/Z_O+1)^2 \quad \text{(Equation 5),}$$

$$P_T=4*(R_S/Z_O)^2/(2*R_S/Z_O+1)^2 \quad \text{(Equation 6),}$$

where "$Z_O$" denotes free space impedance approximately equal to 376.7 Ω.

The skilled artisan will appreciate that a susceptor described by a particular value of the surface resistance $R_S$ can be modeled by an infinite number of surrogate layers of different values of thickness (d) and conductivity (σ), as long as Equation 2 is conserved. As shown in FIG. 2, the simulated value of the transmitted power does not depend on the thickness of the surrogate dielectric layer in the considered ranges of thickness and surface conductance. Also, the simulated values of the absorbed and reflected power do not depend on the model thickness for surface conductance below 0.003 S. For higher values of surface conductance, the absorbed and reflected power become dependent on the surrogate layer thickness, which, therefore, should not be set too high. Indeed, a thickness of about 1 mm ensures the accuracy of all RAT properties better than 3% for, the highest conductance considered. The susceptors of surface conductance below 0.003 S were accurately simulated using a surrogate layer as thick as 4 mm.

Simulation of the Susceptor in the Microwave Oven Cavity

The surrogate layer approach was used to estimate the amount of electromagnetic power absorbed by the susceptor attached to the cylinder. The cylinder was made of water at room temperature and placed inside the oven cavity. The surrogate layer thickness and conductivity were set according to the criteria determined above, and the scenarios of static and rotating objects were analyzed. In the case of the static object, the influence of its size was also considered. The amount of power absorbed by the susceptor and water as a function of the surface resistance are shown in the present figures.

Numerical Model of the Investigated Structure

Applicants performed simulations to estimate the power absorbed by the susceptor surface attached to the cylinder made of water ($\in_r$=78.6 and σ=1.43 S/m). In the simulations, oven cavity dimensions of 267 mm in the x-direction, 270 mm in the y-direction, and 188 mm in the z-direction were used. The simulations also used a feeding waveguide having dimensions of 18 mm in the x-direction, 78 mm in the y-direction, and 80 mm in the z-direction. The feeding waveguide was located in a back, left portion of the oven cavity. Excitation in the form of TE01 mode at 2.45 GHz is launched from the upper end of the waveguide.

A lossless plate of a relative dielectric constant equal to 6, which represents a glass plate found in most household microwaves, was placed 15 mm above the bottom of the cavity, and had a diameter of about 227 mm and a height of about 15 mm. Two different sizes of cylinders made of water were analyzed. The first was a smaller cylinder with 34 mm in diameter and 34 mm in height, and the second was a bigger cylinder with 80 mm in diameter and 80 mm in height.

For the smaller cylinder, both static and rotating scenarios are used in the simulations. The static cylinder was positioned co-axially with the z-axis at the intersection of the x and y-axis ("position 1"). A center of the cylinder rotating around the center of the plate was positioned about 50 mm along the x-axis from the center of the static cylinder ("position 2"). The influence of the cylinder size was also analyzed for the static object. In the simulations, the susceptor was attached to all sides of the cylinder, the thin metal layer was modeled as a surrogate dielectric layer of 1 mm thickness, and its conductivity was calculated by Equation 2.

A set of simulations as a function of surface conductance of susceptor was performed for each of the above scenarios. The feature of QuickWave software for automatic integration of dissipated power[9] over the user-defined part of the load was used. The integration was performed twice during each simulation. The first integration was performed to determine the total amount of power absorbed by the water and the susceptor, and the power absorbed by the susceptor was obtained. The difference between the two values was then calculated.

The calculated values of power were normalized to the time-average power available from the source using the following equation:

$$P=(100*P_d)/P_{av}[\%] \quad \text{(Equation 7)},$$

where "P" denotes the percentage of power absorbed by water of water and susceptor, "$P_d$" denotes power in watts absorbed by water or water and susceptor, and "$P_{av}$" denotes time-averaged value of power available from the source. Since the problem is linear, the actual value of $P_{av}$ was irrelevant.

Simulation Results

Figure 3:
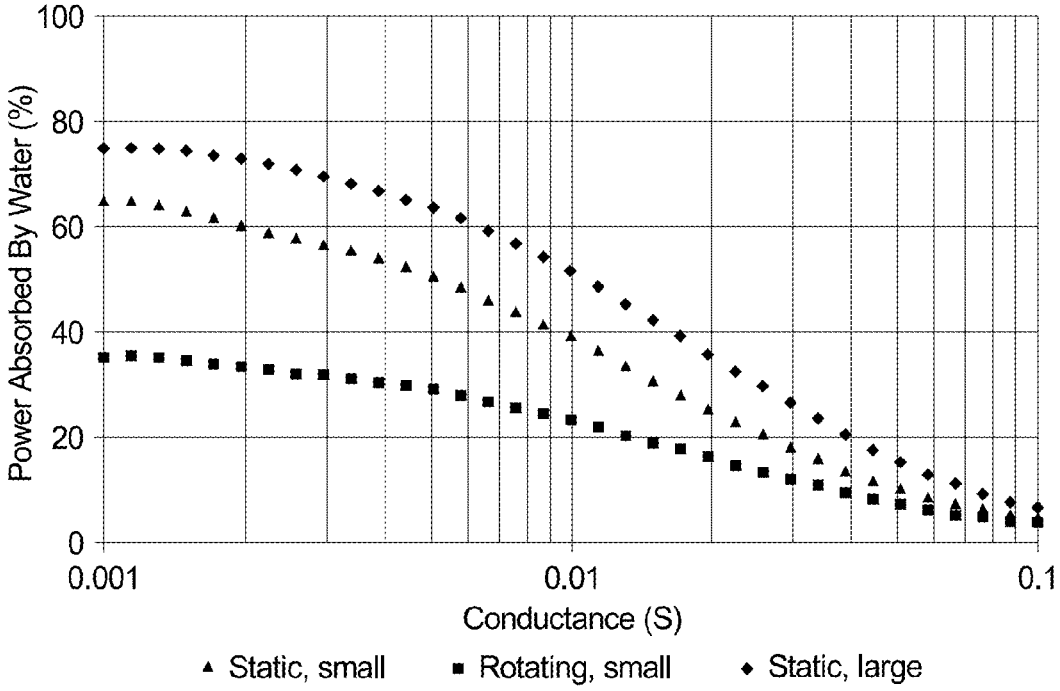
FIG. 3 is a graph of power absorbed by the water load as a function of surface conductance for the static and rotating small cylinder size and the static big cylinder.
Figure 4:
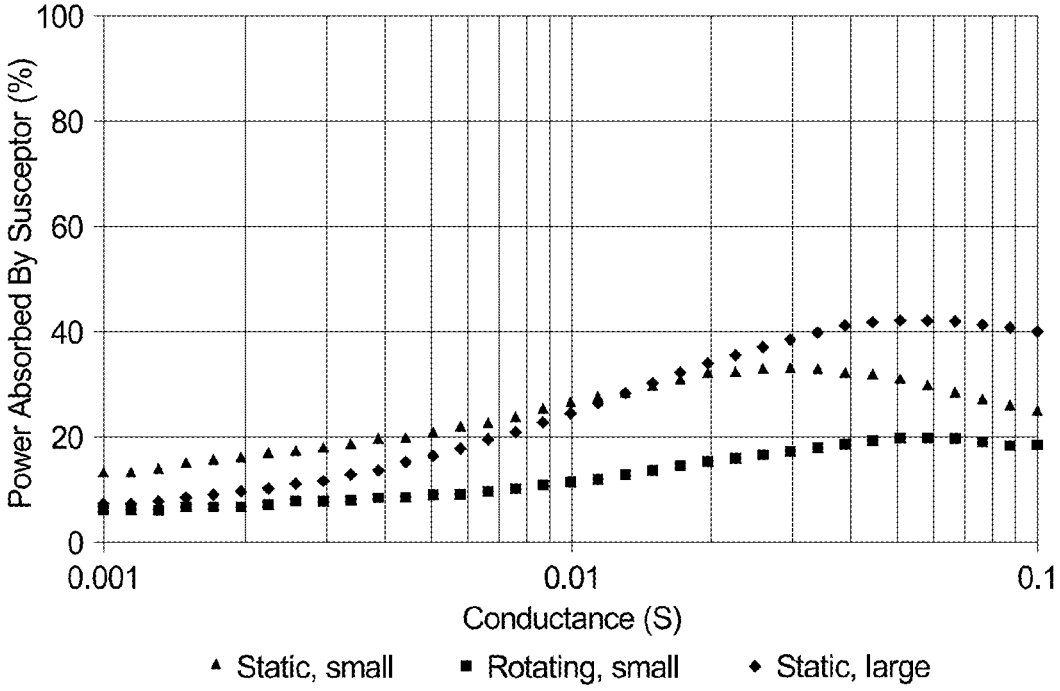
FIG. 4 is a graph of power absorbed by the susceptor as a function of its surface conductance for the static and rotating small cylinder and the static big cylinder.
Figure 5:
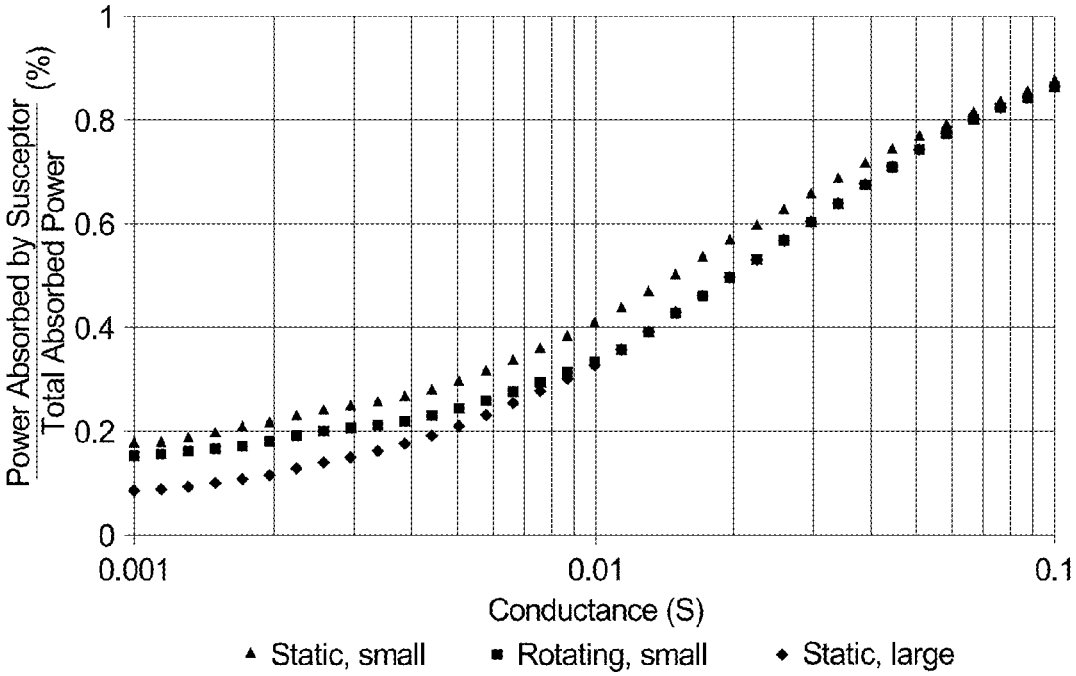
FIG. 5 is a graph showing the ratio of power absorbed by the susceptor to the total amount of power absorbed by the susceptor and the load.

The results of simulations as a function of surface conductance for the static and rotating small cylinder and the static big cylinder are shown in FIGS. 3 and 4. The ratios of power absorbed by the susceptor to the total amount of absorbed power are shown in FIG. 5. The values presented in FIGS. 3 and 4 for the scenario including rotation of the object were averaged over nine angular positions.

As can be seen in the figures, the bigger cylinder made of water, wrapped with the susceptor and located at the center of the static plate, absorbs more than the smaller cylinder at the same position and under the same conditions. When the smaller cylinder is shifted by 50 mm from the center and rotates, the amount of power absorbed by water further decreases.

The simulations further demonstrate that the position and size of the load have the biggest influence on the amount of power absorbed by water when the susceptor has the lowest surface conductance (FIG. 3). For increasing surface conductance, the influence of the load position and size on the amount of power absorbed by water decreases, but the actual amount of power absorbed by water also decreases. Under the same conditions, the amount of power absorbed by the susceptor tends to increase. This demonstrates shielding properties of high conductance of 0.1 S, nearly 90% of total dissipated power is absorbed by the susceptor.

It has also been shown that a planar susceptor in free space exhibits the highest absorbing properties when its surface conductance is about 0.005 S. In the present case of the susceptor surrounding the cylindrical load in the cavity, these maximum absorbing capabilities were shifted towards higher values of the surface conductance (FIG. 4). The actual value of the surface conductance leading to the highest absorbing properties depends on the object position and size and, in the considered cases, falls in the range between 0.03 S and 0.07 S. In the same range, the influence of the object position and size on the actual amount of power absorbed by the susceptor is most pronounced (FIG. 4).

For the present simulation scenarios, the total amount of power absorbed by the water cylinder and the attached susceptor depended mainly on the absorptive properties of the cylinder for surface conductance between 0.001 S and 0.01 S, while, for surface conductance above 0.01 S, it depended mainly on the absorptive properties of susceptor layer.

CONCLUSIONS

Applicants were able to perform effective electromagnetic simulations of food heating in domestic microwave ovens using FDTD simulations with the previously proposed surrogate dielectric layer model of metal susceptors. In this Example, the accuracy of the model was validated against the exact analytical solution taken from the literature for a planar susceptor without cracks. It has been shown that a 4 mm thick model provides results indistinguishable from the analytical ones if the surface conductance of the susceptor is below 0.01 S. For higher surface conductance, thinner models should be used, and the 1 mm model ensures 2% accuracy. The highest absorptive properties of the susceptors are demonstrated by the susceptors of surface conductance close to 0.005 S.

The 1 mm model was applied to practical simulation of the cylindrical water load surrounded with the susceptor and processed in the domestic oven. In view of the present simulations, Applicants have found that the highest absorptive properties of the susceptor were then shifted to surface conductance values higher than in the free space case and dependent on the position and size of the heated object. Applicants have also found that, for increasing surface conductance, the susceptor develops shielding properties with respect to the load, which can have the effect of a more pronounced surface heating. For example, for surface conductance above 0.7 S, the susceptor absorbs over 80% of total dissipated power, moreover, the total dissipated power decreases due to increasing reflections. As a result, the amount of power dissipated in the water load drops below 6% of power available from the magnetron source.

Example 2

Maintenance of Conductivity

Figure 6:
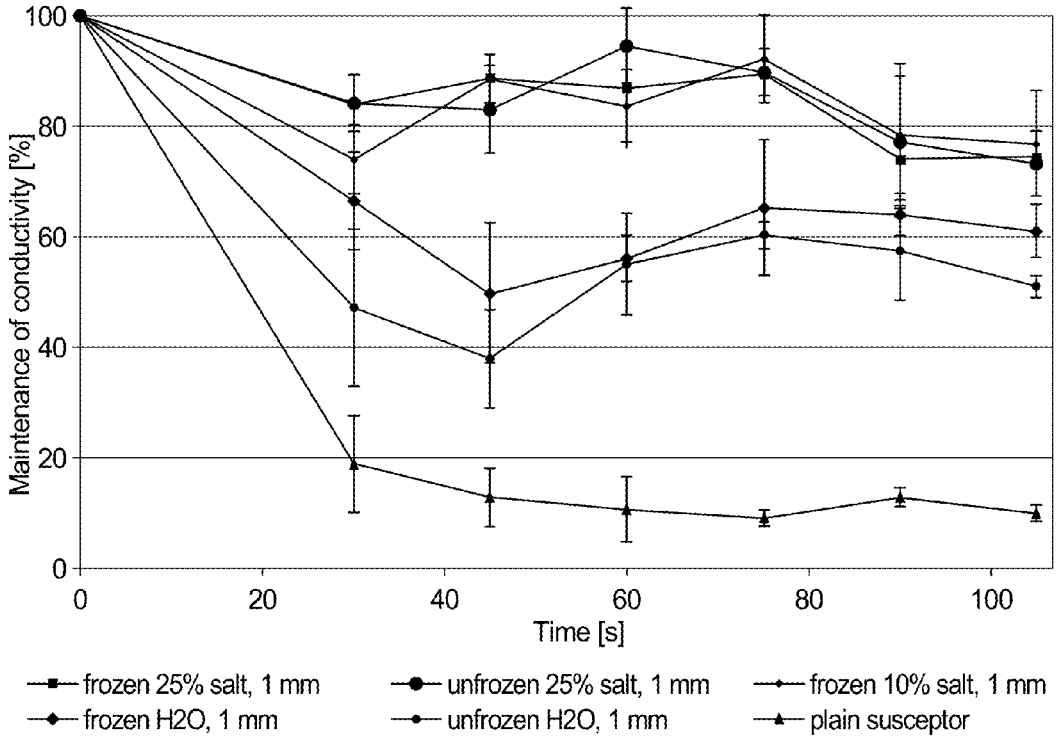
FIG. 6 is a line graph showing maintenance of electrical conductivity of several microwave susceptors.

For comparison purposes, Applicants tested the maintenance of electrical conductivity of several protected (i.e., shielded) susceptors and one unprotected susceptor. The graph of FIG. 6 illustrates the protective effect of salt water layers, which were created with tissue paper as a substrate. As discussed above, the skilled artisan will appreciate, however, that the shielding layer need not be comprised of tissue paper and may be any material capable of acting as a strong dielectric (a material having a high value for $\in'$) or a dielectric with a high loss factor ($\in''$). Other possibilities include, for example, paper products of other weights, fibers, yarns, cottons, etc.

FIG. 6 shows the development of conductivity of a standard (i.e., plain) susceptor, when exposed to microwaves. Without protection, the conductivity drops to below 20% after only 30 seconds. This means that the susceptor has cracked and therefore become too transmissive for the purpose of microwave cooking foods contained within the susceptor package (with strong surface heating of the susceptor). The remaining curves on the graph illustrate the maintenance of conductivity for frozen or unfrozen substrate layers of the shielding layer, with composite susceptors having tissue paper immersed in the indicated salt water concentrations. As illustrated by the graph, a 1.0 mm layer of 25% salt solution was able to keep the susceptor conductivity intact, and the shielding layer provided shielding effects when both frozen and unfrozen. However, the resulting dough temperature was not high enough. Although not graphed, Applicants achieved very good results with a 0.25 mm layer of 25% salt solution.

Example 3

Fiber-Optical Temperature Distribution Measurements

To analyze the conductivity and shielding effects of composite susceptors of the present disclosure, Applicants wrapped a dual-component microwaveable food product in a composite susceptor of the present disclosure and baked the dual-component microwaveable food in a microwave oven. The microwaveable food product was an ice cream filled cookie (17% water content, 7 mm thick around the ice cream center). In a first experiment, the ice cream filled cookie was wrapped in a standard susceptor, and in a second experiment, the ice cream filled cookie was wrapped in a composite susceptor of the present disclosure. Before wrapping, Applicants prepared the ice cream filled cookies, and placed fiber-optical probes at locations corresponding to (i) the cookie position, (ii) the ice cream position and (iii) the interface between the cookie and the ice cream.

Figure 7:
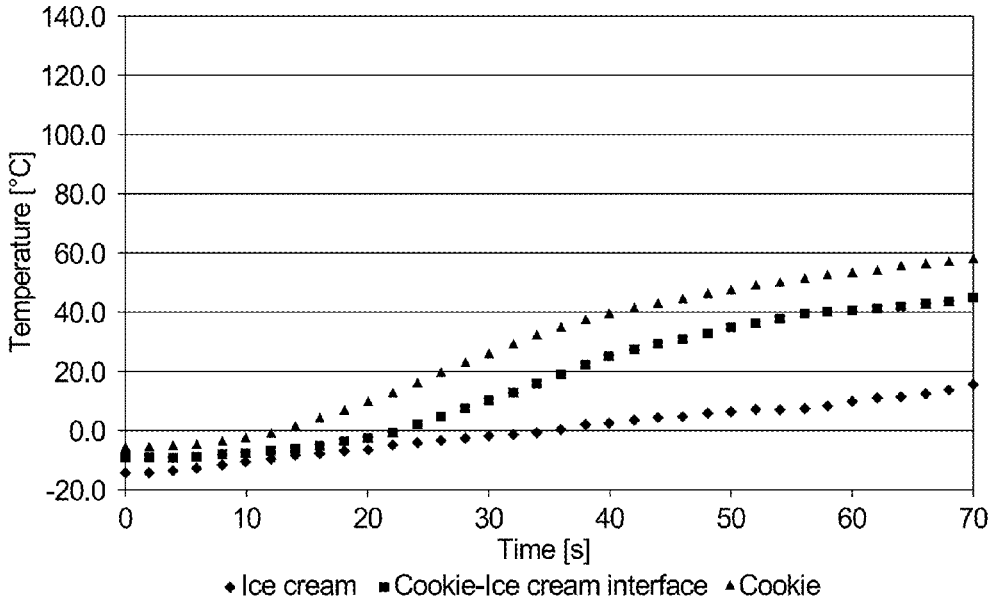
FIG. 7 is a graph of temperature v. time for an ice cream filled cookie.

As is shown by FIG. 7, which used the standard microwave susceptor, the temperature of the ice cream quickly rises above 0° C. At the time the temperature of the ice cream is above 0° C., however, the temperature of the cookie is barely warm. As such, it is clear that standard susceptors are unable to provide a suitable temperature distribution for the microwaveable product.

Figure 8:
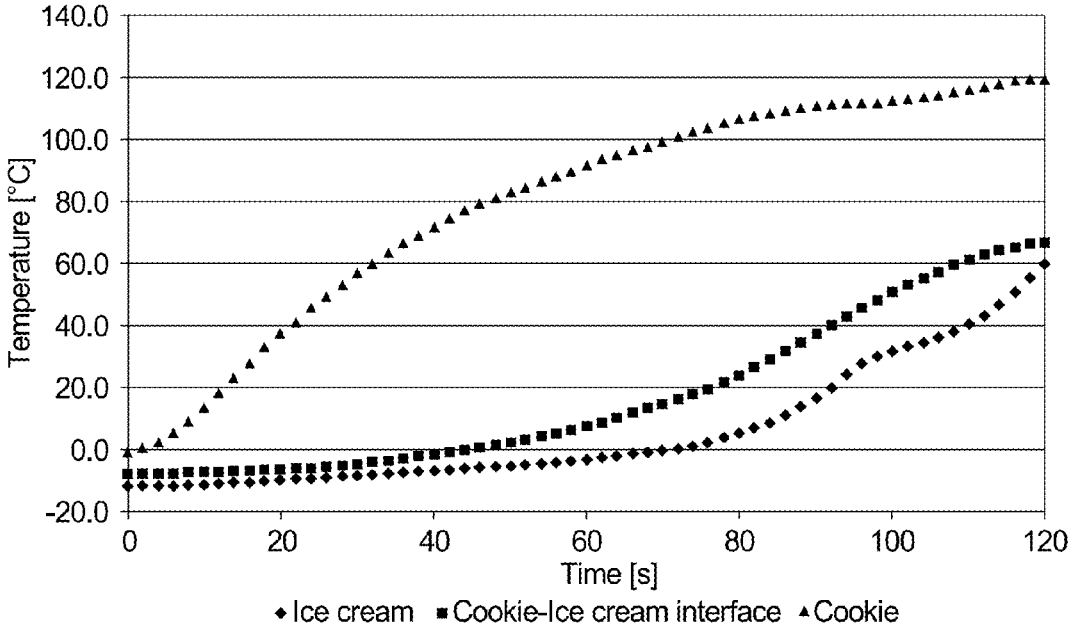
FIG. 8 is a graph of temperature v. time for an ice cream filled cookie in accordance with an embodiment of the present disclosure.

On the other hand, however, FIG. 8 is a graph of an ice cream filled cookie having the same size and composition as that in FIG. 7, but being baked in a composite susceptor of the present disclosure. The composite susceptor used in connection with FIG. 8 included two standard microwave susceptors that were covered with a shielding layer of 0.25 mm tissue paper dipped in a salt water solution of 25%. As can be clearly seen by FIG. 8, the ice cream filling stayed cold for an amount of time that was sufficient to heat the cookie to an acceptable temperature to properly bake the cookie.

Figure 9:
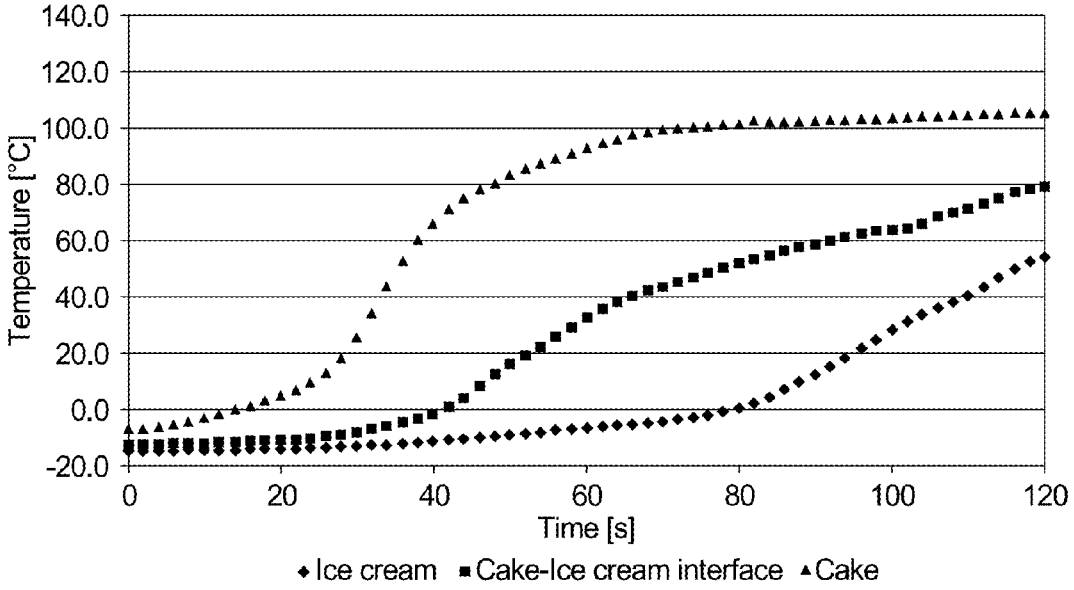
FIG. 9 is a graph of temperature v. time for an ice cream filled cake in accordance with an embodiment of the present disclosure.

For comparative reasons, FIG. 9 includes a similar curve corresponding to a cake outer portion having an ice cream filling. In this regard, the cookie casing was replaced by a cake casing that was 14 mm thick with a 32% water content. The difference in size from the cookie to the cake is because the cake composition is more porous and less compact. As can be seen in FIG. 9, there was a dramatic temperature increase in the cake composition, which Applicants believe may be due to complex heat transfer mechanisms. Indeed, without being bound to any theories, Applicants believe that the heat transfer mechanism of the dough portion of the present microwaveable food can include both classical conduction and evaporation/condensation. In this regard, a more porous dough with a higher water content tends to show a steeper temperature curve, which is desirable with a hot-and-cold microwaveable product concept.

Figure 10:
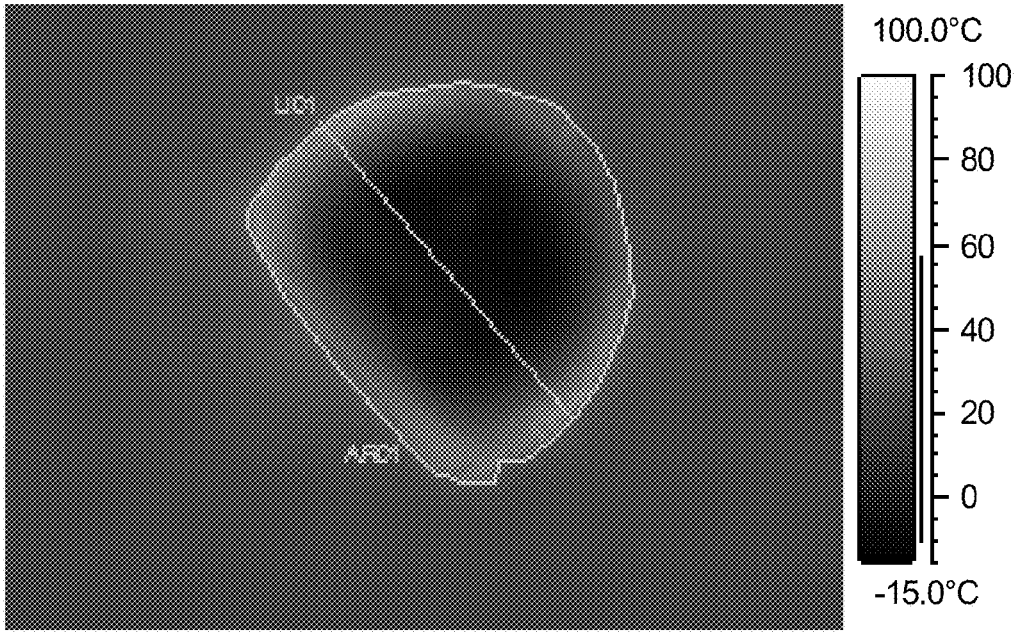
FIG. 10 is temperature profile for a microwaveable cookie product in accordance with an embodiment of the present disclosure.
Figure 11:
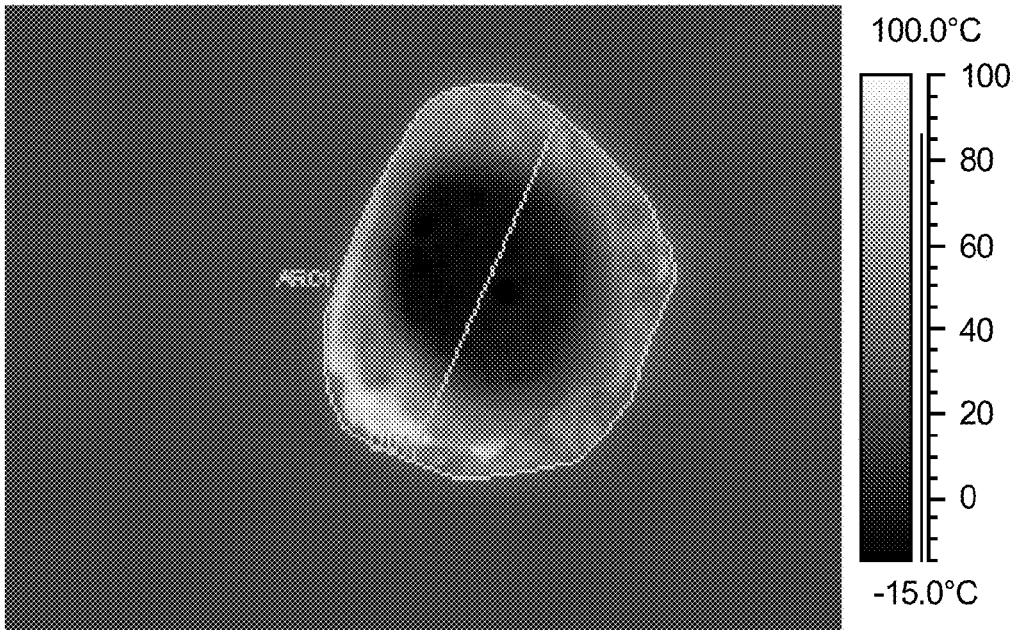
FIG. 11 is temperature profile for a microwaveable cake product in accordance with an embodiment of the present disclosure.

To further evaluate heat transfer mechanisms of different dough compositions, Applicants wrapped one pure cookie product (e.g., no ice cream) in aluminum foil and one pure cake product (e.g., no ice cream) in aluminum foil and deep-fried the products at 180° C. for two minutes. FIG. 10 shows an infrared picture of the cookie product and FIG. 11 shows an infrared picture of the cake product. Based on these two images, it appears that the cake product heats up to a greater temperature on the outside (it has a lower heat capacity by volume), but leaves the center colder. This phenomenon is understood when taking into account that the heat transfer coefficient in the case of evaporation/condensation is very temperature dependent. Where the material is hot, more water has been evaporated, which will carry more latent heat towards the colder areas. In the colder areas near the center, evaporation is insignificant. Applicants believe that the porous nature of the cake product in FIG. 10 shows less conduction than the cookie of FIG. 11, which leaves the center of the cake colder.

Example 4

Comparison of Conventional Oven Baking and Microwave Oven Baking

To determine whether the composite susceptors of the present disclosure impart an acceptable temperature profile to a microwaveable food that is similar to the temperature profile imparted by a conventional oven, Applicants performed the following experiment.

An ice cream filled cookie was prepared using a cookie dough formulation according to the recipe in Table 1 below.

TABLE 1

List of Ingredients for Cookie Dough

| Ingredients | Amount (%) |
|---|---|
| Margarine | 10.7 |
| Sugar | 24.3 |
| Salt | 0.3 |
| Butter | 3.6 |
| Vanilla Flavor | 0.5 |
| Heat-treated Wheat Flour | 45.8 |
| Sodium Bicarbonate | 0.3 |
| Waxy Rice Starch | 1.1 |
| Gum Methocel | 0.2 |
| Whole Egg Powder | 2.1 |
| Water | 9.8 |
| Sugar Molasses | 1.3 |

The ice cream filling was a vanilla ice cream.

Conventional Oven Cooking

The ice cream filled cookie was baked in a conventional oven until the desired level of cooking was achieved in order to determine the temperature profile of an ice cream filled cookie baked in a conventional oven. The ice cream filled cookie was baked in a pre-heated conventional oven for about 5 minutes at a temperature of about 287° C. The temperature distribution of the baked ice cream filled cookie was determined using thermal imaging. The thermal distribution is set forth in FIG. 12.

Microwave Oven Cooking

A second ice cream filled cookie was placed in a composite microwave susceptor of the present disclosure and cooked in a microwave oven until desired cooking was achieved. The composite susceptor included two layers of a standard susceptor material plus a layer of 0.25 mm tissue paper soaked in a 25% salt water solution. The ice cream filled cookie was cooked in the composite susceptor for about 60 seconds in an 800 Watt microwave oven. The temperature distribution of the ice cream filled cookie was determined using thermal imaging. The thermal distribution is set forth in FIG. 13.

Figure 12:
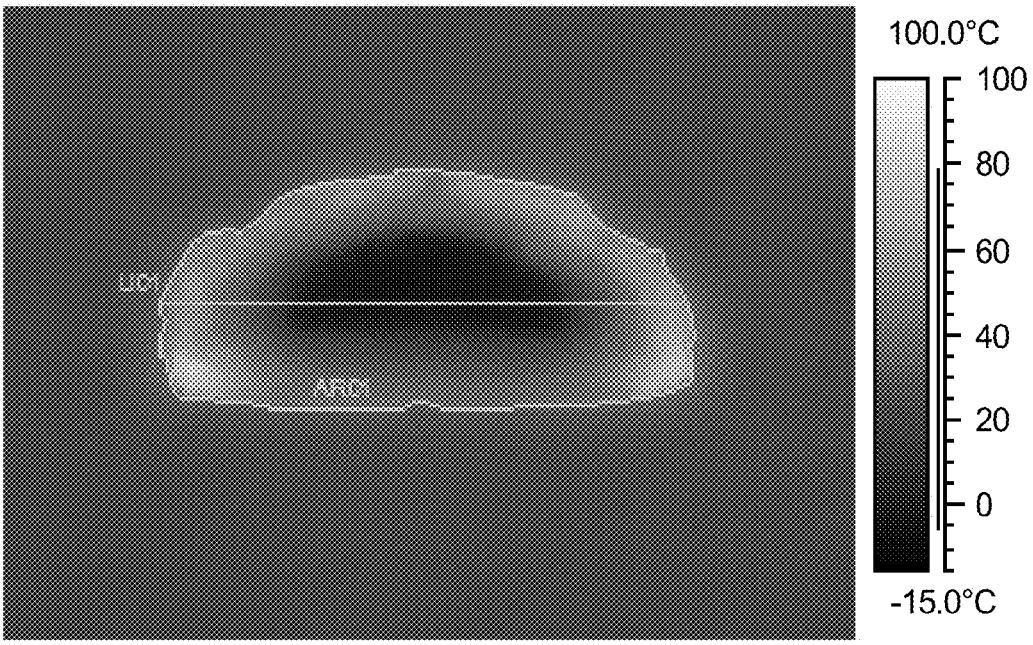
FIG. 12 is a temperature profile of a microwaveable food product baked in a conventional oven in accordance with an embodiment of the present disclosure.
Figure 13:
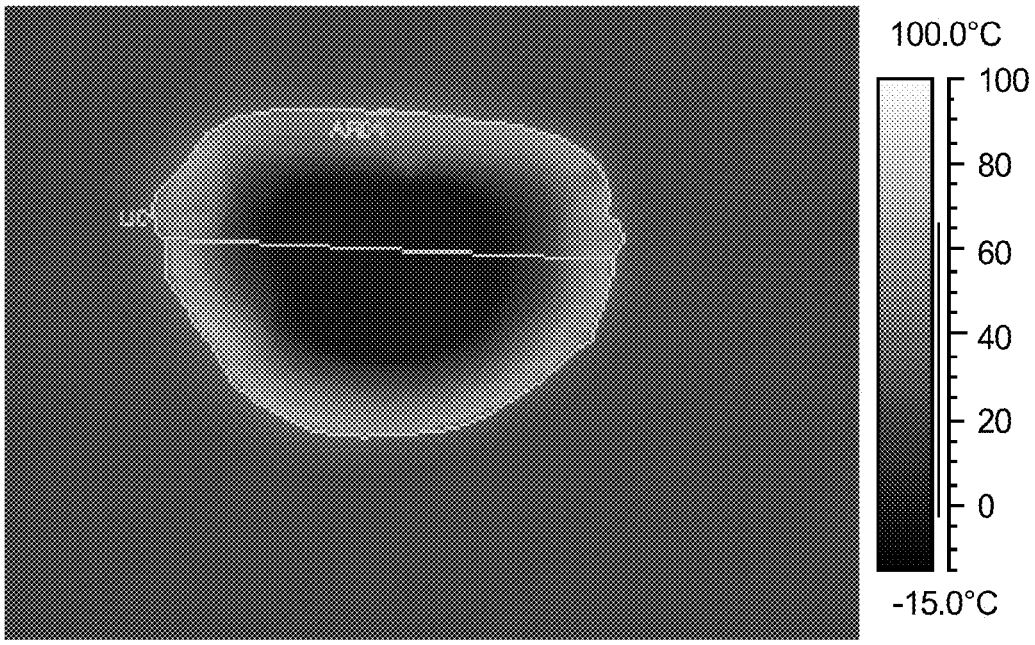
FIG. 13 is a temperature profile of a microwaveable food product baked in a microwave oven in accordance with an embodiment of the present disclosure.

As can be seen by the comparison of FIGS. 12 and 13, the second ice cream filled cookie that was cooked in a composite susceptor of the present disclosure in a microwave oven has a temperature distribution that is similar to the first ice cream filled cookie that was baked in a conventional oven. Indeed, Applicants have found that the double layer of a standard susceptor plus a 0.25 mm layer of 25% salt solution provided results that were almost identical to the ice cream cookie baked in the conventional oven. This is advantageous because the present composite susceptors now allow a hot-and-cold food product to be prepared in a reasonable amount of time, with more efficient energy consumption than with a conventional oven, and with increased surface heating while maintaining the frozen or chilled nature of the cold inner portion.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

REFERENCES

1. M. R. Perry et al., "Susceptors in microwave packaging," Ch. 9 in M. W. Lorence et al., Development of packaging and products for use in microwave ovens, Woodhead Publishing Limited and CRC Press, London (2009).
2. J. Cesnek, et al., "Properties of thin metallic films for microwave susceptors," Czech. J. Food Sci., vol. 21, pp. 34-40 (2003).
3. J. Krupka et al., "Contact-less measurements of resistivity of semiconductor wafers employing single post and split post dielectric resonator techniques," IEEE Trans. IM, pp. 1839-1844 (October, 2009).
4. M. Celuch et al., "Effective modeling of microwave heating scenario including susceptors," Intn'l Conference on Recent Advances in Microwave Theory and Applications, 21-24, pp. 404-405 (November 2008).
5. W. K. Gwarek et al., "Modeling and measurements of susceptors for microwave heating applications," $10^{th}$ seminar Computer Modeling & Microwave Power Engineering, Modena, Italy, 28-29 (February 2008).
6. W. K. Gwarek et al., "Modeling and measurements of susceptors for microwave heating applications," Recent Advances in Microwave Power Applications and Techniques, IMS 2009 Workshop (Jun. 12, 2009).
7. A. Taflove et al., "Local subcell models of fine geometric features," Ch. 10 in A. Taflove et al., "Computation Electrohydrodymanics, The Finite-Difference Time-Domain Method," 3d Edition, Artech House, Boston-London, pp. 407-462.
8. QuickWave-3D 91997-2009), QWED Sp.z.o.o., http://www.qwed.eu.
9. M. Celuch et al., "Properties of the FDTD method relevant to the analysis of microwave power problems," J. Microwave Power and Electromagnetic Energy, vol. 41(4), pp. 62-80 (2007).

The invention is claimed as follows:

1. A microwaveable package comprising:

a container defining an interior and comprising a microwave shielding material surrounding the interior, wherein at least a portion of the microwave shielding material is a conductive susceptor comprising an electrical resistance that is below about 100 Ω, and the conductive susceptor comprises a standard microwave susceptor layer and a shielding layer comprising a substrate including a source of mobile charges, wherein the shielding layer is at least substantially metal free.

2. The microwaveable package of claim 1, wherein the conductive susceptor comprises an electrical resistance from about 10 Ω to about 80 Ω.

3. The microwaveable package of claim 1, wherein the microwave shielding material is entirely comprised of the conductive susceptor.

4. The microwaveable package of claim 1, wherein a second portion of the microwave shielding material is a pure microwave shield.

5. The microwaveable package of claim 4, wherein the pure microwave shield is a metal layer.

6. The microwaveable package of claim 1, wherein the conductive susceptor comprises a second standard microwave susceptor layer.

7. The microwaveable package of claim 1, wherein the substrate has a thickness from about 0.05 mm to about 3.0 mm.

8. The microwaveable package of claim 1, wherein the source of mobile charges is a salt water solution having a concentration from about 10% to about 30% by weight.

9. A method for increasing a surface heating of a food product, the method comprising the steps of:

providing a food product in an interior of a container, the container comprising a microwave shielding material surrounding the interior, wherein at least a portion of the microwave shielding material is a conductive susceptor comprising an electrical resistance that is below about 100 Ω, the conductive susceptor comprises a standard susceptor layer and a shielding layer comprising a substrate including a source of mobile charges, wherein the shielding layer is at least substantially metal free; and heating the food product in the container in a microwave oven for a predetermined amount of time.

10. The method of claim 9, wherein the predetermined amount of time is between about 30 seconds to about 4 minutes.

11. The method of claim 9, wherein the microwave shielding material is entirely comprised of the conductive susceptor.

12. The method of claim 9, wherein a second portion of the microwave shielding material is a pure microwave shield.

13. The method of claim 12, wherein the pure microwave shield is a metal layer.

14. The method of claim 9, wherein the substrate has a thickness from about 0.05 mm to about 3.0 mm.

15. The method of claim 9, wherein the source of mobile charges is a salt water solution that has a concentration of about 25% by weight.

16. The method of claim 9 wherein the conductive susceptor further comprises a second standard microwave susceptor layer located between the first standard microwave susceptor layer and the shielding layer.

* * * * *